US010463937B2

(12) United States Patent
Taitel

(10) Patent No.: US 10,463,937 B2
(45) Date of Patent: Nov. 5, 2019

(54) BASEBALL SWING TRAINING APPARATUS

(71) Applicant: SweetSpot Sports LLC, Short Hills, NJ (US)

(72) Inventor: Elijah Taitel, Short Hills, NJ (US)

(73) Assignee: EXTRA BASE SPORTS LLC, Chester, NJ (US)

( * ) Notice: Subject to any disclaimer, the term of this patent is extended or adjusted under 35 U.S.C. 154(b) by 0 days.

(21) Appl. No.: 15/939,910

(22) Filed: Mar. 29, 2018

(65) Prior Publication Data

US 2019/0299075 A1 Oct. 3, 2019

(51) Int. Cl.

| | |
|---|---|
| ***A63B 69/00*** | (2006.01) |
| ***A63B 71/06*** | (2006.01) |
| ***A63B 21/00*** | (2006.01) |
| ***A63B 21/055*** | (2006.01) |
| ***A63B 102/18*** | (2015.01) |

(52) U.S. Cl.

CPC .... *A63B 69/0002* (2013.01); *A63B 21/00061* (2013.01); *A63B 21/0552* (2013.01); *A63B 71/0622* (2013.01); *A63B 2069/0008* (2013.01); *A63B 2071/0633* (2013.01); *A63B 2102/18* (2015.10); *A63B 2102/182* (2015.10)

(58) Field of Classification Search

CPC ..... A63B 69/0002; A63B 71/0622; A63B 21/0552; A63B 21/00061; A63B 2069/0008; A63B 2071/0633; A63B 2102/182; A63B 2102/18

See application file for complete search history.

(56) References Cited

U.S. PATENT DOCUMENTS

| | | | | |
|---|---|---|---|---|
| 5,269,511 | A | 12/1993 | Chavez | |
| 5,360,209 | A * | 11/1994 | Mollica | A63B 15/005 473/457 |
| 2010/0234144 | A1 | 9/2010 | Sutlovich et al. | |
| 2010/0285907 | A1* | 11/2010 | Deschesnes | A63B 15/00 473/437 |
| 2015/0224381 | A1* | 8/2015 | Rodriguez | A63B 69/0002 473/457 |

* cited by examiner

*Primary Examiner* — Jeffrey S Vanderveen

(74) *Attorney, Agent, or Firm* — Carter, DeLuca & Farrell LLP

(57) ABSTRACT

The present disclosure relates to a baseball swing training apparatus. In various embodiments, the apparatus includes a handle, a shaft having a tip portion, a handle stopper having a receptacle, a tip stopper coupled to the tip portion of the shaft, a sliding sleeve positioned around the shaft, where the sliding sleeve is shorter than the shaft and cooperates with the shaft to be slideable along the shaft between the handle stopper and the tip stopper, and an elastic band assembly having one end coupled to the sliding sleeve and another end configured to be couplable to the receptacle of the handle stopper.

19 Claims, 5 Drawing Sheets

BASEBALL SWING TRAINING APPARATUS

TECHNICAL FIELD

The present disclosure relates to baseball swing training, and more particularly, to an apparatus for training both mechanics and power for a baseball swing.

BACKGROUND

Different types of baseball hitting can be trained using different types of training devices. For example, a device for training power hitting is described in U.S. Pat. No. 5,269,511, and a device of training contact hitting is described in U.S. Pat. No. 5,360,209. While existing devices are beneficial for their specific purposes, each device has deficiencies when training for other types of hitting. Accordingly, there is continuing interest in development of more generalized baseball swing training devices.

SUMMARY

The present disclosure relates to an apparatus for training both mechanics and power for a baseball swing.

In accordance with aspects of the present disclosure, an apparatus for training a baseball swing includes a handle, a shaft having a tip portion, a handle stopper having a receptacle, a tip stopper coupled to the tip portion of the shaft, a sliding sleeve positioned around the shaft, where the sliding sleeve is shorter than the shaft and cooperates with the shaft to be slideable along the shaft between the handle stopper and the tip stopper, and an elastic band assembly having one end coupled to the sliding sleeve and another end configured to be couplable to the receptacle of the handle stopper.

In various embodiments, when the elastic band assembly is coupled to the receptacle of the handle stopper, the elastic band assembly resists movement of the sliding sleeve towards the tip stopper.

In various embodiments, the elastic band assembly includes an elastic band and an anchor secured to the elastic band, where the anchor is couplable to the receptacle of the handle stopper. In various embodiments, when the anchor is not coupled to the receptacle of the handle stopper, the anchor abuts the sliding sleeve.

In various embodiments, the apparatus includes one or more other elastic band assemblies and the handle stopper includes one or more other receptacles corresponding to the one or more other elastic band assemblies. In various embodiments, each elastic band assembly of the elastic band assembly and the one or more other elastic band assemblies is separately couplable to the handle stopper. In various embodiments, each elastic band assembly provides a different elasticity. In various embodiments, each elastic band assembly provides the same elasticity.

In various embodiments, the tip stopper includes a receptacle. The apparatus includes another elastic band assembly having one end coupled to the sliding sleeve and another end configured to be couplable to the receptacle of the tip stopper. In various embodiments, when the other elastic band assembly is coupled to the receptacle of the tip stopper, the other elastic band assembly resists movement of the sliding sleeve towards the handle stopper.

Further details and aspects of exemplary embodiments of the present disclosure are described in more detail below with reference to the appended figures.

DETAILED DESCRIPTION

The present disclosure relates to an apparatus for training both mechanics and power for a baseball swing. As will be described in detail herein, training of swing mechanics is accomplished by a sliding component that audibly and/or visually indicates whether a swing is proper, and training of swing power is accomplished by elastic components that resist movement of the sliding component. Although the present disclosure is described with respect to a baseball swing, the present disclosure is applicable to a softball bat swing as well. Accordingly, the term baseball is used herein for convenience, and descriptions relating to a baseball swing should be understood to be descriptions relating to a softball swing as well.

Figure 1:
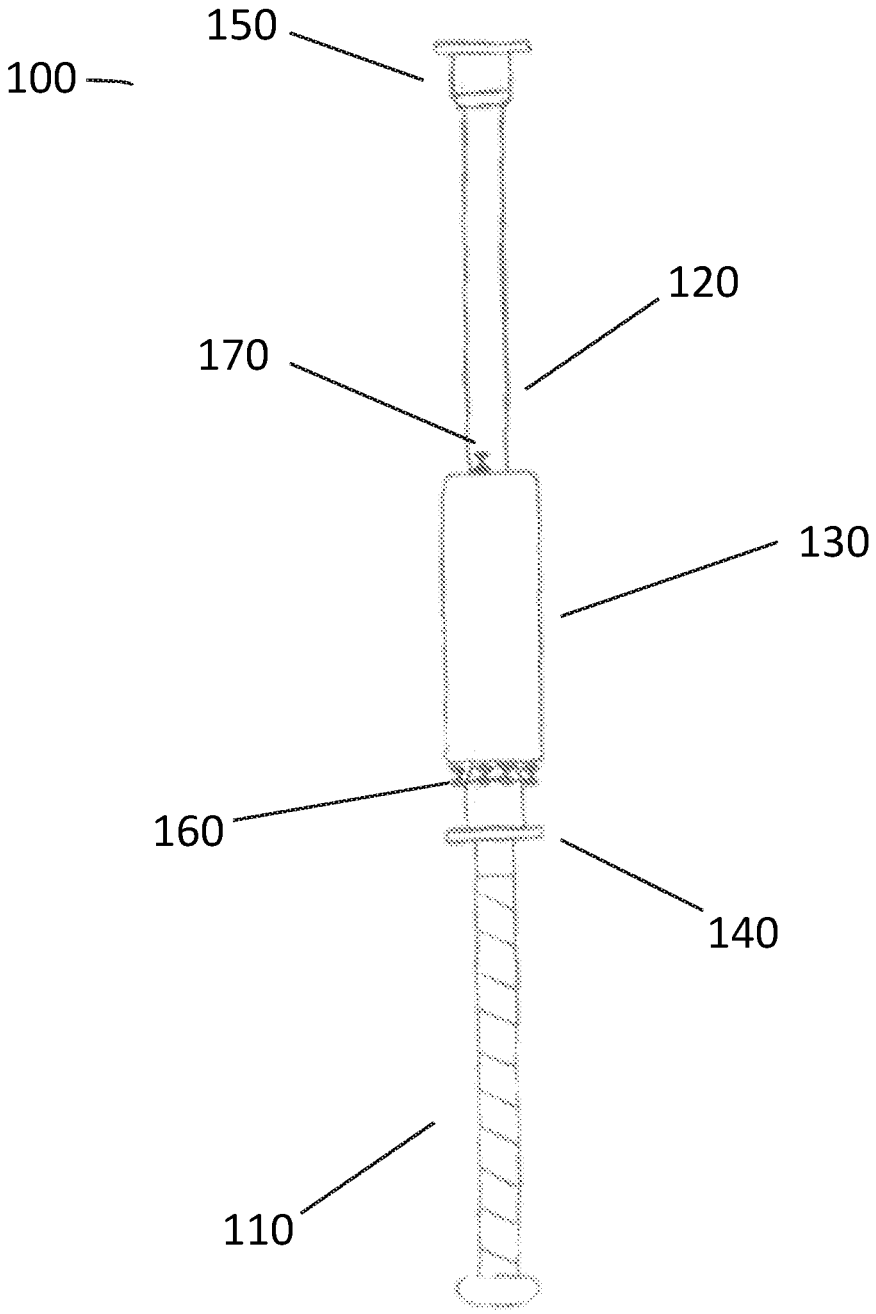
FIG. 1 is a diagram of an embodiment of a swing training apparatus in accordance with aspects of the present disclosure.

Referring to FIG. 1, there is shown a baseball swing training apparatus 100 in accordance with aspects of the present disclosure. The illustrated training apparatus 100 includes a handle 110 and a shaft 120, which are coupled to each other, and a sliding sleeve 130 that is positioned around the shaft 120. The handle 110 and the shaft 120 can be coupled to each other in various ways. In various embodiments, the handle 110 and the shaft 120 can be coupled to each other by screw threads. For example, one end of the shaft 120 can be hollow and can receive the handle 110. The end of the handle 110 that fits into the shaft 120 can have screw threads (not shown) on the end portion of the handle 110. The hollow portion of the shaft 120 that receives the handle 110 can include complementary screw threads (not shown) on the inner surface of the hollow portion. In this manner, the handle 110 can be screwed into and coupled with the shaft 120. The screw coupling is merely exemplary, and other types of removable or non-removable coupling are contemplated to be within the scope of the present disclosure. For example, in various embodiments, the shaft 120 and the handle 110 can be non-removably coupled together using adhesives or welding.

As mentioned above, and with reference also to FIG. 2, a sliding sleeve 130 is positioned around the shaft 120. The shaft 120 includes a tip portion 122 and a near portion 124 that is opposite the tip portion 122. The sliding sleeve 130 can slide along the shaft 120 in both directions, i.e., from the near portion 124 to the tip portion 122, and from the tip portion 122 to the near portion 124. The sliding sleeve 130 can interface with the shaft 120 in various ways. In various embodiments, the sliding sleeve 130 can simply wrap around the shaft 120. Low friction coatings can be applied to the sliding sleeve 130 and the shaft 120 to enable the sliding movement. In various embodiments, the shaft 120 can include channels (not shown) and the inner portion of the sliding sleeve 130 can include fins (not shown) that fit into and slide along the channels. In various embodiments, the sliding sleeve 130 and/or the shaft 120 can include rollers or bearings (not shown) to enable the sliding movement. Persons skilled in the art will understand the implementation of these various mechanisms. Other mechanisms for enabling the sliding sleeve 130 to slide along the shaft 120 are contemplated to be within the scope of the present disclosure.

In various embodiments, the sliding sleeve 130 can have a cylindrical shape or generally cylindrical shape. In various embodiments, the sliding sleeve 130 can have a frustoconical shape. In various embodiments, the sliding sleeve 130 can have a shape that approximates or matches the shape and size of the tip portion of a bat barrel, including the shape and size of a little league bat barrel, a minor league bat barrel, a major league bat barrel, or a softball bat barrel.

With continuing reference to FIG. 1, the baseball swing training apparatus 100 also includes stoppers 140, 150 which halt the sliding of the sliding sleeve 130. In particular, a handle stopper 140 is positioned at or adjacent to the near portion 124 of the shaft 120 or over the handle 110, and a tip stopper 150 is positioned at or adjacent to the tip portion 122 of the shaft 120. The handle stopper 140 prevents the sliding sleeve 130 from sliding into the handle 110. The tip stopper 150 prevents the sliding sleeve 130 from sliding off the shaft 120 from the tip of the shaft 120. As shown in FIG. 1, the sliding sleeve 130 is shorter than the length of the shaft 120 and is slideable along the shaft 120 between the handle stopper 140 and the tip stopper 150. The handle stopper 140 and the tip stopper 150 can have various shapes. In various embodiments, the handle stopper 140 and the tip stopper 150 can include a flange and a bung-shaped stopper portion, as illustrated in FIG. 1. Other shapes for the stoppers 140, 150 are contemplated to be within the scope of the present disclosure.

In various embodiments, the stoppers 140, 150 can be removably or non-removably secured to the shaft 120. In various embodiments, the stoppers 140, 150 can be removably secured to the shaft 120 by screw threads (not shown). For example, the stoppers 140, 150 can fit over the shaft 120, and the inner surface of the stoppers 140, 150 can include screw threads (not shown). The outer surface of the shaft 120 can include complementary screw threads that couple with the screw threads on the inner surface of the stoppers 140, 150. In this manner, the stoppers 140, 150 can screw onto the shaft 120 and be coupled to the shaft 120. In various embodiments, the stoppers 140, 150 can be non-removably coupled to the shaft 120 by, for example, adhesives or welding. In various embodiments, the stoppers 140, 150 can be formed as an integral part of the shaft 120, rather than coupled to the shaft 120. In various embodiments, the handle stopper 140 can be coupled to the handle 110 rather than to the shaft 120, or can be formed as an integral part of the handle 110. The coupling mechanisms described above are exemplary, and other coupling mechanisms are contemplated to be within the scope of the present disclosure.

Accordingly, described above is a baseball swing training apparatus 100 that includes a handle 110, a shaft 120, a sliding sleeve 130, and stoppers 140, 150. The training apparatus 100 can be used in live batting practice. When the batter holds the apparatus at the start of a swing, the sliding sleeve 130 abuts the handle stopper 140. In the motion of swinging the bat, the sliding sleeve 130 will slide along the shaft 120 from the handle stopper 140 to the tip stopper 150. A batter's swing mechanics can be determined by audibly and/or visually examining the movement of the sliding sleeve 130. For example, if the sliding sleeve 130 reaches the tip stopper 150 too early before contacting a ball, or does not yet reach the tip stopper 150 when contacting the ball, the batter's swing mechanics may need to be improved. Towards the end of the swing, the sliding sleeve 130 slides from the tip stopper 150 back towards the handle stopper 140 and is in contact with the handle stopper 140 at the end of the swing.

As mentioned above herein, the baseball swing training apparatus can be used to train swing power in addition to swing mechanics. In accordance with aspects of the present disclosure, the baseball swing training apparatus 100 includes one or more elastic band assemblies 160 that are coupled to the sliding sleeve 130 and that can operate to resist movement of the sliding sleeve. In this manner, the elastic band assemblies 160 require a batter to produce more power to move the sliding sleeve 130 along the shaft 120.

Figure 2:
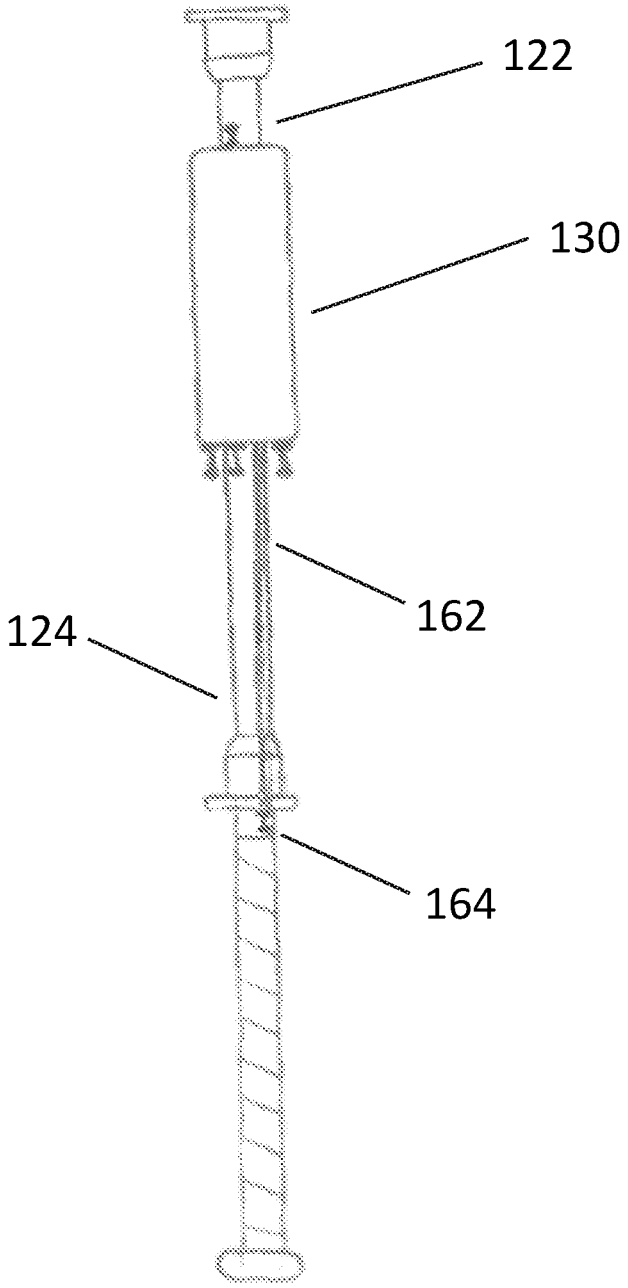
FIG. 2 is a diagram of the swing training apparatus of FIG. 1 with an elastic band assembly anchored, in accordance with aspects of the present disclosure.

Referring now to FIG. 2, and in accordance with aspects of the present disclosure, each elastic band assembly 160 includes an elastic band 162 and an anchor 164. One end of the elastic band 162 is secured to the anchor 164, and the other end of the elastic band 162 can be secured to the sliding sleeve 130. The elastic band 162 can be secured to the anchor 164 in various ways. In various embodiments, the elastic band 162 can be tied to the anchor 164. In various embodiments, the anchor 164 can be molded and formed around an end of the elastic band 162 such that when the anchor 164 is solidly formed, one end of the elastic band 162 is within the anchor 164.

Figure 3:
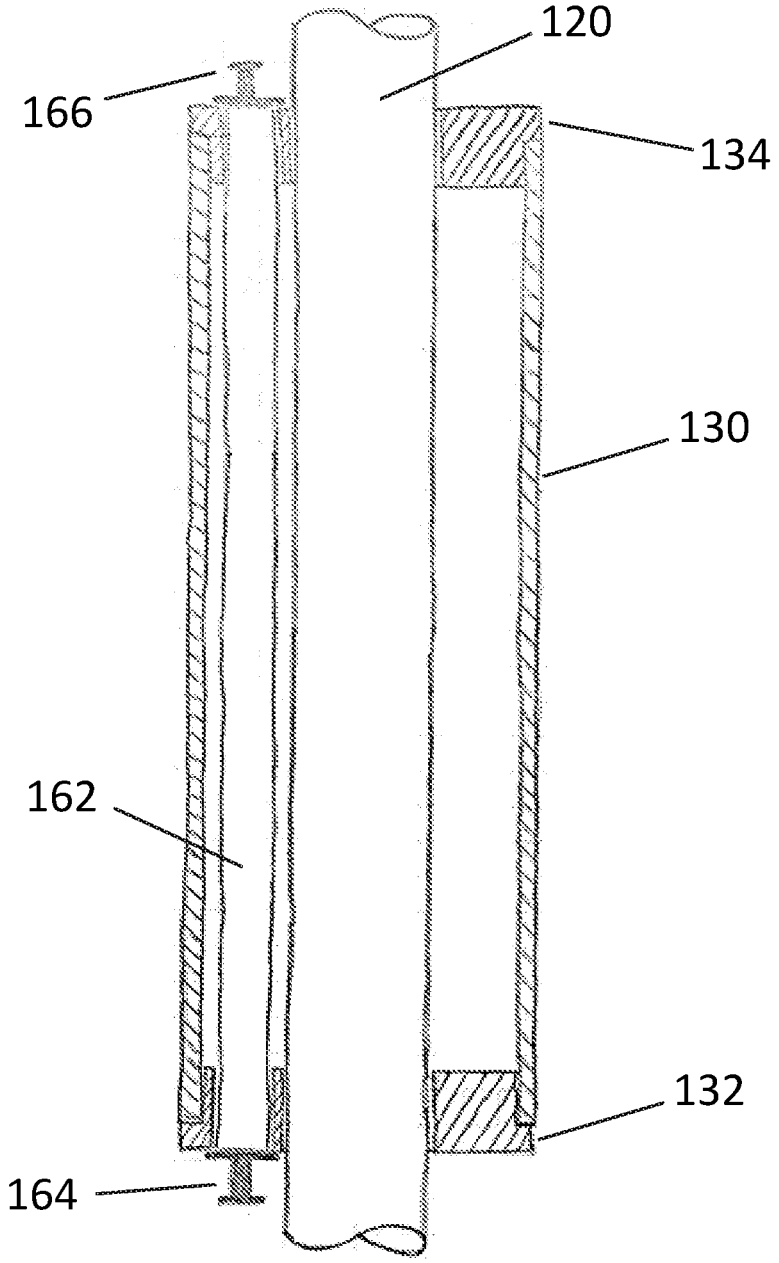
FIG. 3 is a diagram of an exemplary internal portion of a sliding sleeve, in accordance with aspects of the present disclosure.

Additionally, the elastic band 162 can be secured to the sliding sleeve 130 in various ways. FIG. 3 shows a sectional view of a portion of the shaft 120, the sliding sleeve 130, and an elastic band assembly 160. In the illustrated embodiment, the sliding sleeve 130 includes the near end 132 and the tip end 134. The elastic band assembly 160 includes the elastic band 162 and the anchor 164 described above. In the illustrated embodiment, the other end of the elastic band 162 can be secured to another anchor 166 in the same way it is secured to anchor 164. The anchors 164, 166 can abut and push against the ends 132, 134 of the sliding sleeve 130 and are unable to enter the sliding sleeve 130. In this manner, the elastic band assembly 160 is secured to the sliding sleeve 130. The embodiment of FIG. 3 is exemplary, and other ways of securing an elastic band assembly 160 to the sliding sleeve 130 are contemplated to be within the scope of the present disclosure. For example, the sliding sleeve 130 can be molded and formed around an end of the elastic band 162 such that when the sliding sleeve 130 is solidly formed, one end of the elastic band 162 is within the sliding sleeve 130.

Referring again to FIG. 2, the anchor 164 of the elastic band assembly 160 can be grasped and pulled to stretch the elastic band 162. When the anchor 164 is not pulled, the anchor 164 abuts the near end of the sliding sleeve 130, as shown in FIG. 1. In this state, the elastic band assembly 160 does not operate to resist movement of the sliding sleeve 130. As shown in FIG. 1 and FIG. 2, the baseball swing apparatus 100 can include multiple elastic band assemblies 160. Each elastic band assembly 160 can be individually pulled, separately from any other elastic band assembly 160. FIG. 2 illustrates one elastic band assembly 160 being pulled while other elastic assemblies are not pulled. In various embodiments, each elastic band assembly can have the same elasticity. In various embodiments, different elastic band assemblies can have different elasticities.

Figure 4:
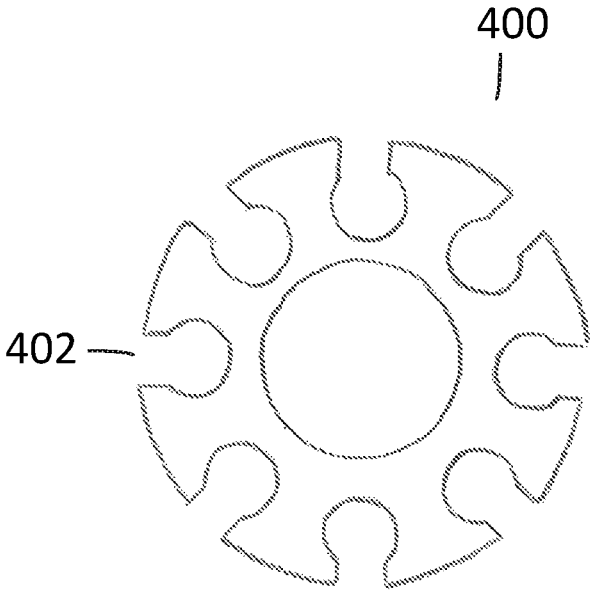
FIG. 4 is a diagram of an exemplary stopper, in accordance with aspects of the present disclosure.
Figure 5:
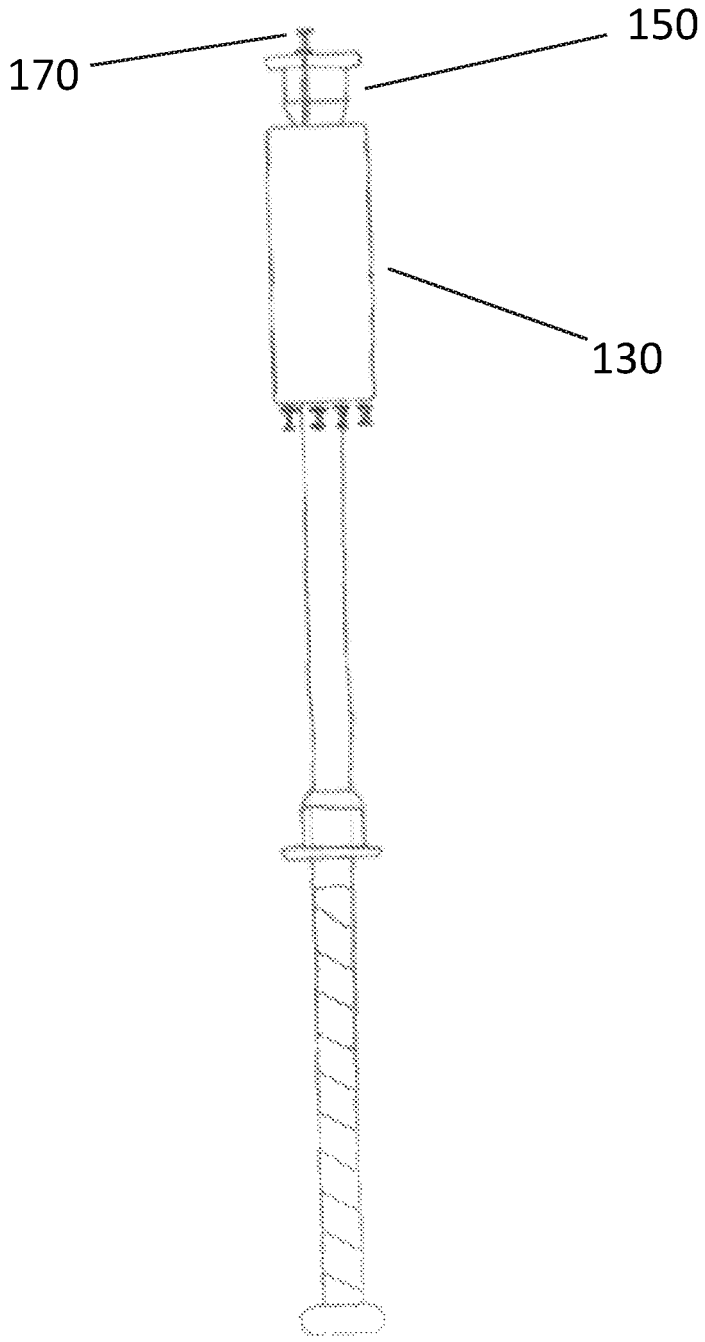
FIG. 5 is a diagram of the swing training apparatus of FIG. 1 with another elastic band assembly anchored, in accordance with aspects of the present disclosure.

In accordance with aspects of the present disclosure, the handle stopper 140 includes one or more receptacles corresponding to the elastic band assemblies 160. FIG. 4 shows a top view of one embodiment of a handle stopper 400 having eight receptacles 402. Each receptacle 402 can receive and secure an anchor of an elastic band assembly. In various embodiments, the handle stopper 400 can include a different number of receptacles 402, such as one receptacle, four receptacles, six receptacles, or another number. The receptacles can be arranged differently than as shown in FIG. 4. In various embodiments, the receptacles can be evenly spaced apart, as illustrated. In various embodiments, the receptacles need not be evenly spaced apart. In the illustrated embodiment, the stopper 400 has a generally circular shape. In various embodiments, the stopper 400 can have another shape. Various configurations of a handle stopper having receptacles are contemplated to be within the scope of the present disclosure.

Referring again to FIG. 1 and FIG. 2, when an elastic band assembly 160 is anchored to the handle stopper 140, the elastic band assembly 160 resists movement of the sliding sleeve 130 towards the tip stopper 150. Accordingly, the batter needs to produce more power to move the sliding sleeve 130 during a swing. The amount of resistance can be adjusted by anchoring different numbers of elastic band assemblies 160, or by anchoring elastic band assemblies 160 having different elasticities. For example, anchoring three elastic band assemblies provides more resistance than anchoring one elastic band assembly.

In accordance with aspects of the present disclosure, the swing training apparatus 100 can include one or more elastic band assemblies 170 that are positioned to couple to the tip stopper 150. The tip stopper 150 can include one or more corresponding receptacles that can receive and secure the elastic band assemblies 170. The descriptions above herein relating to elastic band assemblies 160 also apply to the elastic band assemblies 170 at the tip end of the sliding sleeve 130. For example, different numbers and arrangements of elastic band assemblies are contemplated, and different ways of forming the elastic band assemblies and of coupling them to the sliding sleeve are contemplated. Additionally, the description of FIG. 4 is applicable to the tip stopper 150 as well.

When an elastic band assembly 170 is coupled to the tip stopper 150, the elastic band assembly 170 resists movement of the sliding sleeve 130 towards the handle stopper 140. This configuration can be used, for example, to secure the sliding sleeve 130 to the tip stopper 150 when a batter is warming up, as the greater weight at the tip of the bat allows the batter to stretch and warm up various muscles. This configuration can also be used to familiarize a batter with the feel of the swing training apparatus 100 when the apparatus contacts a ball.

Accordingly, described herein is a baseball swing training apparatus that trains both mechanics and power of a swing. Because the training apparatus has adjustable resistance, it can easily be used by batters in different stages of swing development.

The embodiments disclosed herein are examples of the disclosure and may be embodied in various forms. For instance, although certain embodiments herein are described as separate embodiments, each of the embodiments herein may be combined with one or more of the other embodiments herein. Specific structural and functional details disclosed herein are not to be interpreted as limiting, but as a basis for the claims and as a representative basis for teaching one skilled in the art to variously employ the present disclosure in virtually any appropriately detailed structure. Like reference numerals may refer to similar or identical elements throughout the description of the figures.

The phrases "in an embodiment," "in embodiments," "in various embodiments," "in some embodiments," or "in other embodiments" may each refer to one or more of the same or different embodiments in accordance with the present disclosure. A phrase in the form "A or B" means "(A), (B), or (A and B)." A phrase in the form "at least one of A, B, or C" means "(A); (B); (C); (A and B); (A and C); (B and C); or (A, B, and C)."

It should be understood that the foregoing description is only illustrative of the present disclosure. Various alternatives and modifications can be devised by those skilled in the art without departing from the disclosure. Accordingly, the present disclosure is intended to embrace all such alternatives, modifications and variances. The embodiments described with reference to the attached drawing figures are presented only to demonstrate certain examples of the disclosure. Other elements, steps, methods, and techniques that are insubstantially different from those described above and/or in the appended claims are also intended to be within the scope of the disclosure.

What is claimed is:

1. An apparatus for training a baseball swing, comprising:
a handle;
a shaft having a tip portion;
a handle stopper having a receptacle;
a tip stopper coupled to the tip portion of the shaft;
a sliding sleeve positioned around the shaft, the sliding sleeve being shorter than the shaft and cooperating with the shaft to be slideable along the shaft between the handle stopper and the tip stopper; and
an elastic band assembly having one end coupled to the sliding sleeve and another end configured to be couplable to the receptacle of the handle stopper,
wherein the elastic band assembly includes an elastic band and an anchor secured to the elastic band, the anchor being couplable to the receptacle of the handle stopper; and
wherein when the anchor is not coupled to the receptacle of the handle stopper, the anchor abuts the sliding sleeve and the elastic band is stretched in a tensioned state.

2. The apparatus of claim 1, wherein when the elastic band assembly is coupled to the receptacle of the handle stopper, the elastic band assembly resists movement of the sliding sleeve towards the tip stopper.

3. The apparatus of claim 1, further comprising at least one other elastic band assembly, wherein the handle stopper includes at least one other receptacle corresponding to the at least one other elastic band assembly.

4. The apparatus of claim 3, wherein each elastic band assembly of the elastic band assembly and the at least one other elastic band assembly is separately couplable to the handle stopper.

5. The apparatus of claim 4, wherein each elastic band assembly provides a different elasticity.

6. The apparatus of claim 4, wherein each elastic band assembly provides a same elasticity.

7. The apparatus of claim 1, wherein the tip stopper includes a receptacle, the apparatus further comprising another elastic band assembly having one end coupled to the sliding sleeve and another end configured to be couplable to the receptacle of the tip stopper.

8. The apparatus of claim 7, wherein when the another elastic band assembly is coupled to the receptacle of the tip stopper, the another elastic band assembly resists movement of the sliding sleeve towards the handle stopper.

9. The apparatus of claim 1, wherein the sliding sleeve has a shape of a tip portion of a bat barrel.

10. An apparatus for training a swing, comprising:

a handle;

a shaft having a tip portion;

a handle stopper having a receptacle;

a tip stopper coupled to the tip portion of the shaft;

a sliding sleeve positioned around the shaft, the sliding sleeve being shorter than the shaft and cooperating with the shaft to be slideable along the shaft between the handle stopper and the tip stopper; and an elastic band assembly having one end coupled to the sliding sleeve and another end configured to be couplable to the receptacle of the handle stopper, wherein the elastic band assembly includes an elastic band and an anchor secured to the elastic band, the anchor being couplable to the receptacle of the handle stopper, and wherein the sliding sleeve encases the elastic band, and wherein the elastic band is unremovable from the sliding sleeve.

11. The apparatus of claim 10, wherein when the elastic band assembly is coupled to the receptacle of the handle stopper, the elastic band assembly resists movement of the sliding sleeve towards the tip stopper.

12. The apparatus of claim 10, wherein when the anchor is not coupled to the receptacle of the handle stopper, the anchor abuts the sliding sleeve and the elastic band is stretched in a tensioned state.

13. The apparatus of claim 10, further comprising at least one other elastic band assembly, wherein the handle stopper includes at least one other receptacle corresponding to the at least one other elastic band assembly.

14. The apparatus of claim 13, wherein each elastic band assembly of the elastic band assembly and the at least one other elastic band assembly is separately couplable to the handle stopper.

15. The apparatus of claim 14, wherein each elastic band assembly provides a different elasticity.

16. The apparatus of claim 14, wherein each elastic band assembly provides a same elasticity.

17. The apparatus of claim 10, wherein the tip stopper includes a receptacle, the apparatus further comprising another elastic band assembly having one end coupled to the sliding sleeve and another end configured to be couplable to the receptacle of the tip stopper.

18. The apparatus of claim 17, wherein when the another elastic band assembly is coupled to the receptacle of the tip stopper, the another elastic band assembly resists movement of the sliding sleeve towards the handle stopper.

19. The apparatus of claim 10, wherein the sliding sleeve has a shape of a tip portion of a bat barrel.

* * * * *